US006537059B2

(12) United States Patent
Lochschmied

(10) Patent No.: US 6,537,059 B2
(45) Date of Patent: Mar. 25, 2003

(54) REGULATING DEVICE FOR A BURNER

(75) Inventor: Rainer Lochschmied, Rheinstetten (DE)

(73) Assignee: Siemens Building Technologies AG, Zurich (CH)

( * ) Notice: Subject to any disclaimer, the term of this patent is extended or adjusted under 35 U.S.C. 154(b) by 0 days.

(21) Appl. No.: 09/850,529

(22) Filed: May 7, 2001

(65) Prior Publication Data

US 2001/0051107 A1 Dec. 13, 2001

(30) Foreign Application Priority Data

May 12, 2000 (DE) ..... 100 23 265
May 26, 2000 (DE) ..... 100 25 769

(51) Int. Cl.[7] ..... F23N 5/112

(52) U.S. Cl. ..... 431/12; 431/25; 431/75; 431/78

(58) Field of Search ..... 431/12, 18, 25, 431/78, 24, 80, 75

(56) References Cited

U.S. PATENT DOCUMENTS 4,588,372 A * 5/1986 Torborg ..... 431/78
5,924,859 A * 7/1999 Nolte et al. ..... 431/12
6,299,433 B1 * 10/2001 Gauba et al. ..... 431/12

FOREIGN PATENT DOCUMENTS

DE 39 37 290 A1 5/1990
EP 0 806 610 A2 11/1997
EP 0 909 922 A1 4/1999
IT MI95U000566 7/1995

* cited by examiner

*Primary Examiner*—James C. Yeung
(74) *Attorney, Agent, or Firm*—Greer, Burns & Crain, Ltd.

(57) ABSTRACT

A regulating device for a burner regulates the air-gas ratio by way of an ionization electrode. In the event of dynamic changes in output preliminary control is implemented in accordance with the invention with two or more stored characteristics.

15 Claims, 3 Drawing Sheets

22
19
17
20
16
1
18
15
14
13
21
27
y = (1- x) * b + x * a
y
x
b
a
30
29
31
28
23
32
26
24
25

REGULATING DEVICE FOR A BURNER

BACKGROUND OF THE INVENTION

1. Field of the Invention

The invention concerns a regulating device for a burner and includes an ionization electrode arranged in the flame region of the burner, and a setting member which influences the fuel flow or the air flow depending on a setting signal.

2. Description of the Prior Art

Ionization electrodes for flame monitoring purposes in burners have long been in use. In general, however, the ratio of the amount of air to the amount of fuel, often referred to as lambda, is mutually matched in regard to any output demand either by a control system (i.e. without feed-back or the like) or by a regulating system (i.e. with feed-back or the like) and sensors. In general lambda at each output demand should be slightly above the stoichiometric value of 1, for example 1.3.

Unlike controlled burners, air ratio-regulated burners react to external influences which alter combustion. They therefore have a higher degree of effectiveness and thus a higher level of efficiency as well as lower pollutant emissions and thus a lower level of environmental pollution. The sensors required for that purpose, often gas sensors, in particular oxygen sensors, or temperature sensors, are however expensive, unreliable, require maintenance and/or involve a short operating life.

For that reason, for many years now burner manufacturers and regulating device manufacturers have endeavored to use the ionization electrode which is already present, not just for flame monitoring but also as a sensor for burner regulation purposes. German Patent DE-A1-39 37 290 describes a test structure for regulating the gas-air ratio, in which the ionization electrode is supplied with a dc voltage. That principle is not very suited to mass production. Monitoring the flame with the same ionization electrode is not possible as for that purpose only the rectifier property of the flame may be used.

Italian Patent IT-95U000566 and European Patent EP-A1-909 922 which describe regulating devices for gas burners appeared some years ago. In a simplified illustration, those specifications describe how the setting member is controlled on the basis of a stored characteristic in the event of dynamically rapid changes in the gas or air volume flow. In contrast, in the event of slow changes in the gas or air volume flow, a fine setting occurs on the basis of a regulation with the ionization signal as a measurement parameter.

Rapid changes in the fuel flow or the air flow typically occur due to sudden changes in the output demand. In addition, changes in air ratio and thus changes in the fuel or air volume flow can be caused by a change in the fuel composition, a change in the air pressure, changes in the gas pressure, temperature changes, fouling and wear of mechanical burner components, and so forth.

The stored characteristic in the regulating devices disclosed in the Italian Patent IT-95U000566 and the European Patent EP-A1-909 922 establishes at each air pressure of the blower, and thus at each demanded level of power, a setting signal which corresponds to an approximately desired status of the setting member for the gas valve. Also described is an alternative regulating device in accordance with which the air volume flow is adapted to the gas volume flow and the stored characteristic approximately establishes the desired blower speed depending on the setting parameter of the gas valve.

A burner-specific characteristic is obtained by the burner being operated under a respective different loading with changing setting member statuses, in which case emission values and a level of efficiency are measured with additional sensors and the desired setting parameters are determined in that way.

Air ratio-regulated burners have advantages over apparatuses which are controlled by means of characteristics. With a constant output, changes in temperature, fuel pressure, air pressure, fuel composition, wear and fouling of mechanical components etc. allow the set working point to drift away.

For that reason, the regulating devices disclosed in the Italian Patent IT-95U000566 and the European Patent EP-A1-909 922 admittedly implement control on the basis of the stored characteristic when rapid changes in output occur, but compensate for the incompleteness thereof insofar as they initially displace the last status of the setting signal a constant distance along the stored characteristic to a new value.

Approximately at the same time the proprietor of the European Patent EP-A2-806 601 developed regulating devices which also have a characteristic stored for the setting signal. The characteristic also basically serves to provide for preliminary control of the setting member in the event of rapid changes in output.

The last-mentioned regulating devices include an ionization evaluating device which is connected downstream of the ionization electrode and which produces an ionization signal, a control unit in which characteristic data for determining a first mode of behavior of the setting member are stored, which at least at times produces a first control signal, and a regulator which produces the above-mentioned setting signal at least at times depending on the ionization signal and at least at times depending on the first control signal.

The above-indicated regulating devices known from the state of the art have disadvantages. More specifically, some use additional sensors and/or do not hold the air-gas ratio very stable upon dynamic variations in output. Market acceptance is correspondingly low.

SUMMARY OF THE INVENTION

According to a first aspect of the present invention, there is provided a regulating device for a burner comprising an ionization electrode arranged in a flame region of the burner, and a setting member which influences a fuel flow or an air flow depending on a setting signal, and is equipped with an ionization evaluating device which is connected downstream of the ionization electrode and which produces an ionization signal;

a control unit in which characteristic data for determining a first mode of behavior of the setting member are stored and which at least at times produces a first control signal;

a regulator which produces the setting signal at least at times depending on the ionization signal and at least at times depending on the first control signal; and wherein also stored in the control unit are characteristic data for determining a second mode of behavior of the setting member, the control unit produces at least at times a second control signal, and the regulator produces the setting signal at least at times depending on the second control signal.

It has been found that a substantial improvement in terms of regulating a burner by way of the ionization electrode lies in the features of the invention that characteristic data for determining a second mode of behavior of the setting member are stored in the control unit, the control unit at least at times produces a second control signal, and the regulator produces the setting signal at least at times depending on the second control signal.

The structure of a regulating device according to the invention requires few resources such as electronic components and computing capacity of a microprocessor. For a one-off initial setting of a regulating device to a certain type of burner, instead of previously one, now two or more burner-specific characteristics have to be established.

Practice has shown that the second control signal makes an above-average contribution to making control of the setting signal more precise.

The regulating device moreover can be so designed that, upon the detection of suitable conditions, it itself implements a setting method for the detection of new characteristic data.

Thus, occasional or regular re-calibration takes place, in order to compensate for any incremental changes in the regulating system, for example wear or fouling of the ionization electrode. Another possible option provides that the control characteristics are determined automatically, even for gases having characteristics that are not covered by the pre-set characteristics.

The characteristic data can be, for example, in the form of the constants in a polynomial up to the third order. The function that is approximately represented by the polynomial establishes a relationship between an input parameter and the setting signal.

The input parameter used for the control curves is primarily the output demand, either in the form of a setting parameter or a measured parameter that corresponds to the output, for example, the speed of rotation of the blower. It will be appreciated that it is also possible to use other values or parameters as an input value for the control characteristics, for example temperature signals of all kinds such as burner temperature, flow and return temperature, and so forth. Further examples are a pressure difference measurement value for determining the gas or air volume flow, a gas or air volume flow measuring device or directly the actuating signal for operation of a gas valve or an oil pump.

Advantageously, the first and second modes of behavior of the setting member depend on input parameters which represent the same value. The measured output demand, or another physical value, can be fed to the control unit by means of a single input parameter, such as the setting value with respect to the speed of rotation of the blower, or by means of input parameters of a different nature, such as the setting parameter and the measured parameter with respect to the blower speed.

The above, however, is not necessarily so. If, in particular, the regulating device has further measurement values available during operation from which it can directly or indirectly determine, for example, the current energy content or the current pressure of the fuel being supplied, then the second input parameter can represent a different value.

Burners are often equipped with a temperature sensor for the boiler temperature. A change in the energy content of the fuel supplied results in a change in the boiler temperature. In the case of such a burner, for example, the setting parameter for the blower speed is the first input parameter, and the change with respect to time of the boiler temperature is the second one. Characteristic data have been stored that determine a first desired mode of behavior of the setting member at different outputs, but with a fixed energy content of the fuel and with other influences also fixed. Also, characteristic data have been stored that determine a second mode of behavior with different energy contents and at a fixed output.

In the previous example, the regulating device, on the basis of changes in boiler temperature which do not correspond to the variation with respect to time of the setting parameter for the blower speed, determines any changes in the current energy content of the fuel being supplied and by use of the characteristic data for the second mode of behavior and the ionization signal, produces a corrected output-dependent control curve. In the case of a dynamic change in output the setting signal will follow the control curve corrected in that way, for example, at a distance which remains uniform.

A wide variety of burner types can be considered here, for example pre-mix gas burners or atmospheric burners with or without an auxiliary blower. In the case of atmospheric burners without an auxiliary blower the air volume flow can be controlled, for example, by way of an air flap or the like.

In an advantageous embodiment of the invention the regulator produces the setting signal at least in part by processing the control signals and determines the mode of processing at least at times depending on the ionization signal.

This invention includes a number of variants. For example, the control unit produces no control signals in a quasi-stable state. The regulating device then implements regulation by way of the ionization signal. As soon as a rapid change in state occurs, however, the regulating device switches over to the rapidly reacting and accurate control by virtue of processing the control signals. The way in which the control signals are processed is previously established, for example, by the ionization signal and remains the same throughout the entire control period. Control is only replaced by regulation again when the state has settled down and the ionization signal trails the current state. In accordance with an alternative embodiment, however, the control signals are permanently produced and both the control signals and also the ionization signal contribute continuously to the setting signal. Hybrid variants are also possible.

In particular it has proven to be advantageous that the regulator at least at times weighs and adds the control signals and that the regulator at least at times determines the weighing depending on the ionization signal.

In an advantageous embodiment of the invention the regulator damps rapid fluctuations in the ionization signal in comparison with slow fluctuations prior to processing the control signals. In particular, the regulator is equipped with a low pass filter for the ionization signal or for a signal resulting therefrom by processing, or with an integrating unit for the ionization signal or for a signal resulting therefrom by processing.

These measures initially only adjust the mode of processing the control signals with a certain delay and/or a smoothing of the ionization signal so that the ionization signal variation that in any case is too sluggish, after a sudden change in state, does not disturb the setting signal. It is only when the situation has settled down again that the ionization signal will slowly act on the mode of processing the control signals in order to allow fine tuning.

In a further embodiment of the invention the control unit also stores characteristic data for determining a mode of behavior of the ionization signal, the control unit produces at least at times a target value signal for the ionization signal, and the regulator produces the setting signal at least at times depending on the target value signal.

By virtue of those measures, the regulating device, or the regulator program thereof, can be of a simple configuration and achieve a high level of reliability. Optionally, the regulating device occasionally or regularly calibrates characteristic data.

In one embodiment of the invention the regulator is advantageously equipped with a comparison unit which at least at times subtracts from the ionization signal the target value signal or a signal resulting therefrom by processing. In this embodiment the regulator can so produce the setting signal that the ionization signal is regulated to the target value signal. That difference can be regulated to zero by means of the above-mentioned integrating unit.

A further embodiment of the invention concerns the stored characteristic data. Advantageously, the first mode of behavior of the setting member has been determined during a burner operation with a first fuel and the second mode of behavior of the setting member has been determined during a burner operation with a second fuel which is different in terms of energy content, in particular if the specific energy content of a fuel is at least 5% higher than that of another fuel.

It has been found that the characteristics, as from that limit value, are so different from each other that they give the regulating device substantial additional information as compared with a regulating device with only one stored characteristic. This substantially increases the extent of some advantages of the invention.

In another embodiment the characteristic data for determining the two modes of behavior of the setting member result from measurements. Alternatively, however, only the characteristic data for the first mode of behavior of the setting member are determined on the basis of measured results. The characteristic data for the second mode of behavior are then calculated from those measured results.

In a variant of the above-indicated embodiment the characteristic data for the second mode of behavior are established on the basis of knowledge of the man skilled in the art about fuel mixtures which are supplied in practice, instead of by means of burner-specific measurements.

Therefore, setting of a regulating device to a certain type of burner is advantageously implemented by two or more burner-specific characteristics being established during operation with different fuels, for example gas mixtures in different conditions.

The invention also includes a method of setting a regulating device. In accordance with that method a burner is equipped with a regulating device according to the invention and with additional sensors for establishing the quality of combustion. Then, the burner is operated with a first fuel with a certain energy content at different output values with respectively different setting member statuses, in which case a desired setting member status is established from the sensor results for each output value. Characteristic data for determining the first mode of behavior of the setting member are established from the desired setting member statuses. Thereafter, the burner is operated with a second fuel with a different energy content at different output values with respectively different setting member statuses, in which case a desired setting member status is established from the sensor results for each output value, and characteristic data for determining the second mode of behavior of the setting member are established from the desired setting member statuses. These steps are optionally repeated for a third or even further fuels. Finally, the established characteristic data are stored in one or more regulating devices. As described above, advantages are entailed in the specific energy content of a fuel being at least 5% higher than that of another fuel.

Alternatively, the burner is operated with a fuel flow under a first pressure at different output values with respective different setting member statuses, in which case a desired setting member status is established from the sensor results for each output value. Characteristic data for determining the first mode of behavior of the setting member are established from the desired setting member statuses. Thereafter the burner is operated with a fuel flow under a different second pressure at different output values with respective different setting member statuses, with a desired setting member status being established from the sensor results for each output value. Characteristic data for determining the second mode of behavior of the setting member are established from the desired setting member statuses and the established characteristic data are stored in the regulating device.

BRIEF DESCRIPTION OF THE DRAWINGS

Some preferred embodiments of the apparatus and the method according to the invention are described in greater detail with reference to the accompanying drawings in which.

DESCRIPTION OF THE PREFERRED EMBODIMENTS

Figure 1:
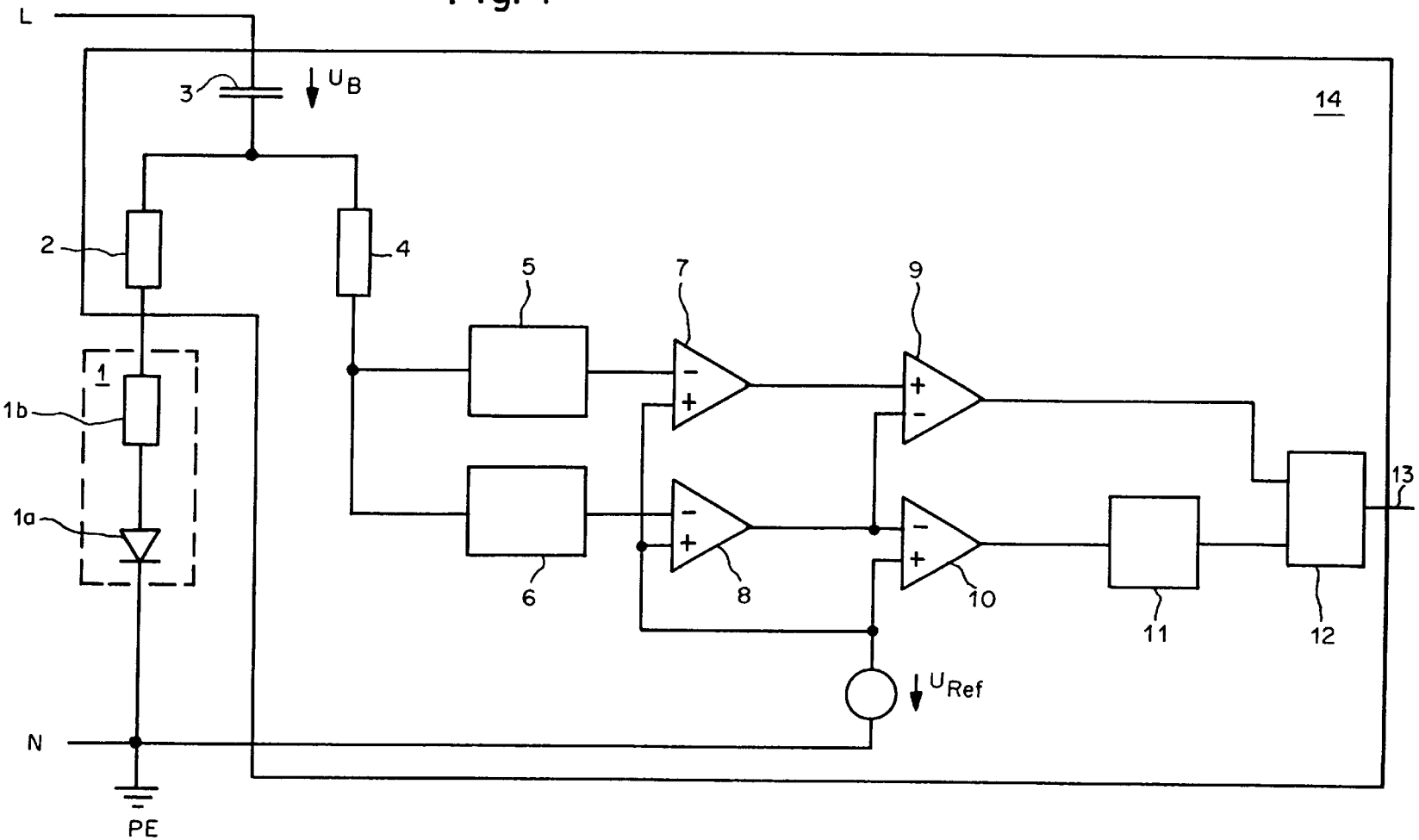
FIG. 1 shows a block circuit diagram of an ionisation evaluating device in a regulating device according to the invention.

FIG. 1 diagrammatically shows the operating principle of an ionization evaluating device 14 according to the invention. In a circuit, the flame 1 is illustrated by means of a diode 1*a* and a resistor 1*b*. An ac voltage of, for example, 230 V is applied by way of L and N. When a flame is present, a greater current flows through the blocking capacitor 3 in the positive half-wave than in the negative half-wave, because of the flame diode 1*a*. As a result, a positive dc voltage $U_B$ is formed at the blocking capacitor 3 between L and a resistor 2 that is provided for the purposes of contact shock protection.

A direct current therefore flows from N to the blocking capacitor 3 through a decoupling resistor 4. The magnitude of the direct current depends on $U_B$ and thus depends directly on the flame resistor 1*b*. The flame resistor 1*b* also influences the alternating current through the decoupling resistor 4, although to a different degree in relation to the direct current. Therefore a direct current and an alternating current flows through the resistor 4, as described above.

A high pass filter 5 and a low pass filter 6 are connected downstream of the resistor 4. The alternating current is filtered out by the high pass filter 5, while the direct current component is blocked. The direct current component which is dependent on the flame resistor 1*b* is filtered out by the low pass filter, while the alternating current is substantially blocked. In an amplifier 7, the alternating current flowing out of the high pass filter 5 is amplified and a reference voltage $U_{Ref}$ is added. In an amplifier 8, the direct current flowing out of the high pass filter, with possibly slight alternating current components, is amplified and a reference voltage $U_{Ref}$ is added.

The reference voltage $U_{Ref}$ can be selected to be of any value, for example $U_{Ref}=0$, but it is preferably so selected that the amplifiers and comparators require only one supply.

At a comparator 9, the ac voltage which issues from the amplifier 7 and the dc voltage issuing from the amplifier 8 are compared to each other and a pulse width-modulated (PWM) signal is produced. If the amplitude of the mains voltage changes, the ac voltage and the dc voltage change in the same relationship and the PWM-signal does not change. The signal variation in the PWM-signal can be set by means of the amplifiers 7 and 8 in a wide range between $\tau=0$ and $\tau=50\%$ pulse duty factor.

The dc voltage component $U_{=}$ is compared in a comparator 10 to the reference voltage $U_{Ref}$. If a flame is present the dc voltage component is greater than the reference voltage ($U_{=}>U_{Ref}$) and the comparator output of the comparator 10 switches to 0. If there is no flame, the dc voltage component is approximately equal to the reference voltage ($U_{=}\approx U_{Ref}$). Because of the slight ac voltage component which is superimposed on the dc voltage component and which the low pass filter 6 does not filter out the dc voltage component is briefly below the reference voltage and pulses appear at the comparator output of the comparator 10. Those pulses are passed to a retriggerable monoflop 11.

The monoflop is triggered so that the pulse series outputted from the comparator 10 comes more quickly than is the pulse duration of the monoflop. As a result if there is no flame a 1 constantly appears at the output of the monoflop. If a flame is present, the monoflop is not triggered and a 0 permanently appears at the output. The retriggerable monoflop 11 thus forms a "missing pulse detector" which converts the dynamic on/off signal into a static on/off signal.

Both signals, the PWM-signal and the flame signal, can now be separately subjected to further processing or linked by means of an OR-member 12. When a flame is present, a PWM-signal 13 appears at the output of the OR-member 12, the pulse duty factor of that signal being a measurement in respect of the flame resistance 1*b*. That ionization signal 13 is fed to the regulator shown in FIG. 2. If there is no flame, the output of the OR-member is permanently at 1. The ionization signal 13 can be transmitted by way of an optocoupler (not shown) in order to provide protective separation between the mains side and the protection low-voltage side.

Figure 2:
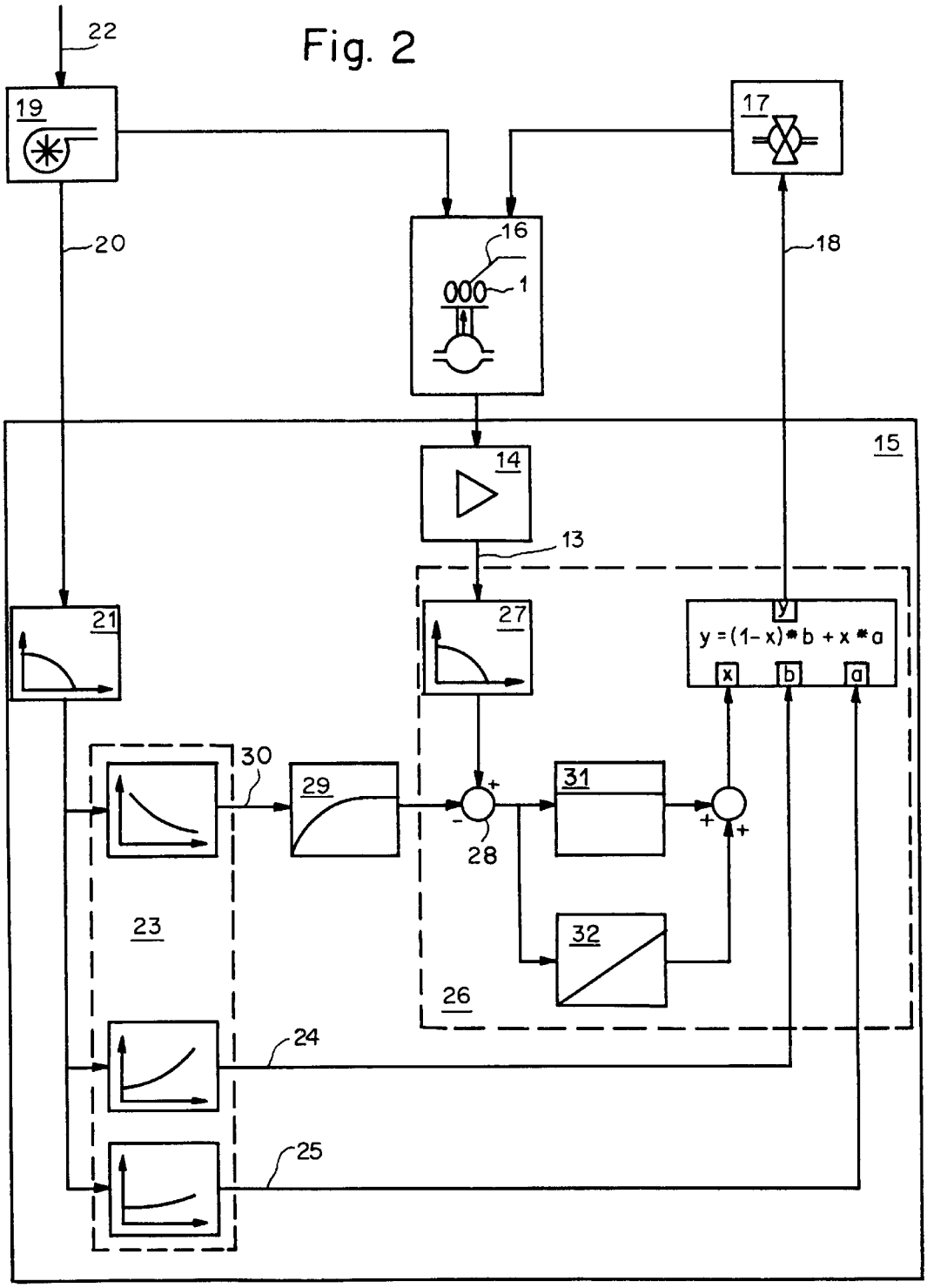
FIG. 2 shows a block circuit diagram of a regulating device according to the invention.

FIG. 2 shows a block circuit diagram of a regulating device 15 according to the invention. The ionization electrode 16 projects into the flame 1. The gas valve 17 is directly or indirectly controlled by the setting signal 18, for example, by way of a motor. Optionally, a mechanical pressure regulator is additionally connected in line.

An air blower 19 is controlled to operate at a speed of rotation which is used as an input parameter. The speed of rotation corresponds to an output demand 22. The rotary speed signal 20 is passed by way of a filter 21 to a control unit 23 which has been designed in the form of a program for execution in a microprocessor. Stored therein are characteristic data which establish the characteristics of a first and a second control signal 24 and 25. The regulator 26 weighs and adds the two control signals and thus determines the setting signal 18. Such processing of the control signals depends on the ionization signal 13.

The ionization signal 13 is first smoothed by the regulator 26 by means of a low pass filter 27 in order to suppress interference pulses and flicker. A target value signal 30 that is produced by the control unit 23 and passed by way of a correction unit 29 is subtracted in a comparison unit 28. An internal regulating value x is determined by a proportional regulator 31 and a parallel integrating unit 32 from the signal that results from processing the ionization signal, the internal regulating value weighing the two control signals 24 and 25 and thus providing for fine regulation of the setting signal 18.

Alternatively the regulating value x can be produced by a PID-regulator or a state regulator from the signal that results from processing the ionization signal.

Figure 3:
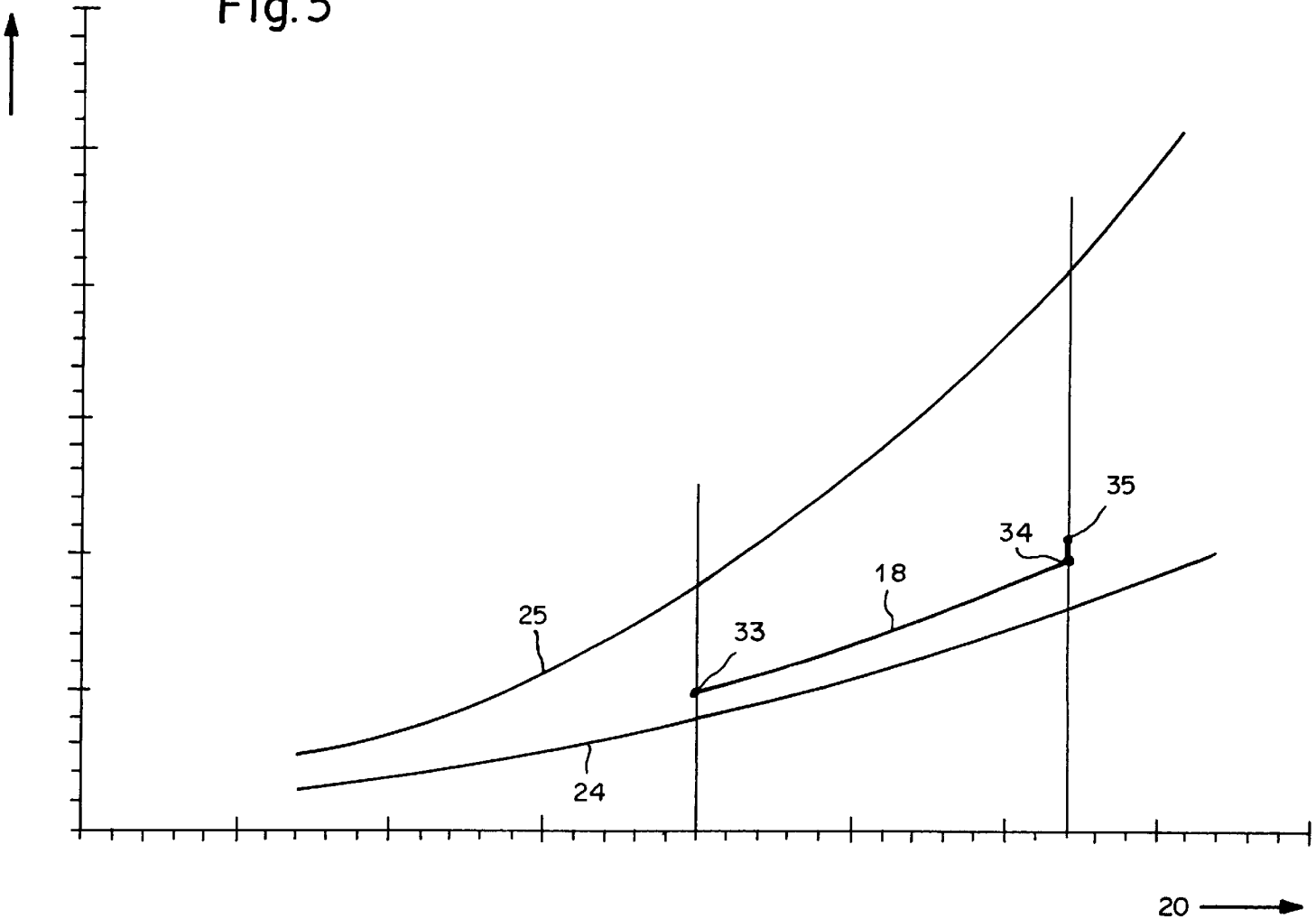
FIG. 3 shows the setting signal of a regulating device according to the invention.

FIG. 3 shows how the setting signal 18 of a regulating device 15 according to the invention varies depending on the rotary speed signal 20. The characteristics of the control signals 24 and 25 respectively concern a fuel gas with a fairly low and a high caloric value respectively.

In a quasi-stable state in which the fuel gas has a medium combustion value and the combustion values also deviate from the characteristics because of other circumstances, the regulating device 15, by way of weighing of the control signals 24 and 25, regulates the setting signal to a value 33 which is virtually optimum for the air-gas ratio. This regulation corresponds to a vertical movement of the setting signal value in FIG. 3.

If now there is a step-like rise in the output demand 22 and a corresponding change in the rotary speed signal 20, then the weighing of the two control signals initially remains scarcely affected. The control signals 24 and 25 themselves however respectively rise rapidly with the change in rotary speed to their correspondingly higher values along the characteristics, and the setting signal 18 likewise rises quickly to the value 34. The controlled value 34 of the setting signal is already highly accurate, and is near to a value which is optimum in terms of the air-gas ratio. As soon as the ionization signal 13 has become adjusted again to the new state, typically after a few seconds, it again finely regulates the weighing of the control signals 24 and 25. In that case the setting signal 18 moves vertically to a value 35 in FIG. 3.

What is claimed is:

1. A regulating device for a burner comprising:

an ionization electrode arranged in a flame region of the burner, and a setting member which influences a fuel flow or an air flow depending on a setting signal; an ionization evaluating device which is connected downstream of the ionization electrode and which produces an ionization signal;

a control unit in which characteristic data for determining a first mode of behavior of the setting member are stored and which at least at times produces a first control signal; and a regulator which produces the setting signal at least at times depending on the ionization signal and at least at times depending on the first control signal;

wherein also stores in the control unit are characteristic data for determining a second mode of behavior of the setting member, the control unit produces at least at times a second control signal, and the regulator produces the setting signal at least at times depending on the second control signal.

2. The regulating device according to claim 1, wherein the regulator produces the setting signal at least in part by processing the control signals, and the regulator determines the mode of processing at least at times depending on the ionization signal.

3. The regulating device according to claim 2, wherein the regulator at least at times weights and adds up the control signals, and the regulator determines the weighting at least at times depending on the ionization signal.

4. The regulating device according to claim 2, wherein prior to processing the control signals the regulator damps rapid fluctuations in the ionization signal.

5. The regulating device according to claim 4, wherein the regulator is equipped with a low pass filter for the ionization signal or for a signal resulting therefrom by processing.

6. The regulating device according to claim 4, wherein the regulator is equipped with an integrating unit for the ionization signal or for a signal resulting therefrom by processing.

7. The regulating device according to claim 1, wherein characteristic data for determining a mode of behavior of the ionization signal are also stored in the control unit, the control unit produces at least at times a target value signal for the ionization signal, and the regulator produces the setting signal at least at times depending on the target value signal.

8. The regulating device according to claim 7, wherein the regulator is equipped with a comparison unit which at least at times subtracts the target value signal or a signal resulting therefrom by processing from the ionization signal or from a signal resulting therefrom by processing.

9. The regulating device according to claim 7, wherein the regulator produces the setting signal such that the ionization signal is regulated to the target value signal.

10. The regulating device according to claim 1, wherein the first mode of behavior of the setting member is determined during a burner operation with a first fuel, and the second mode of behavior of the setting member is determined during a burner operation with a second fuel.

11. The regulating device according to claim 10, wherein an energy content of the first fuel is at least 5% different than that of the second fuel.

12. A method of setting a regulating device for a burner, comprising the steps of:

equipping the burner with a regulating device and with additional sensors for establishing a quality of combustion;

operating the burner with a first fuel with a first energy content at different output values with respective different setting member statuses, wherein a desired setting member status is established from sensor results for each output value;

establishing characteristic data for determining a first mode of behavior of a setting member from the desired setting member statuses;

operating the burner with a second fuel with a second energy content at different output values with respective different setting member statuses, wherein a desired setting member status is established from the sensor results for each output value;

establishing characteristic data for determining a second mode of behavior of the setting member from the desired setting member statuses; and storing the established characteristic data in the regulating device.

13. The method of setting a regulating device for a burner according to claim 12, wherein the first energy content of the first fuel is at least 5% different than that of the second energy content of the second fuel.

14. The method of setting a regulating device for a burner according to claim 12, further comprising the steps of:

operating the burner with a fuel flow under a first pressure at different output values with the different first pressure setting member statuses, wherein the desired setting member status is established from the sensor results for each output value;

establishing characteristic data for determining the first mode of behavior of the setting member from the different first pressure setting member statuses;

operating the burner with a fuel flow under a different second pressure at different output values with respective different second pressure setting member statuses, wherein a desired setting member status is established from the sensor results for each output value;

establishing characteristic data for determining the second mode of behavior of the setting member from the different second pressure setting member statuses; and storing the established characteristic data in the regulating device.

15. The method of setting a regulating device for a burner according to claim 14, wherein the first fuel flow pressure is at least 9% different than the second fuel flow pressure.

* * * * *